United States Patent [19]

Lennon et al.

[11] 4,030,802

[45] June 21, 1977

[54] TERMINAL BLOCK ASSEMBLY AND MULTIPLE CONNECTOR ASSEMBLY THEREFOR

[75] Inventors: David C. Lennon, Morrison, Ill.; Richard A. Wandler, Clinton, Iowa

[73] Assignee: General Electric Company, Fort Wayne, Ind.

[22] Filed: Dec. 29, 1975

[21] Appl. No.: 645,045

[52] U.S. Cl. ..... 339/192 R

[51] Int. Cl.[2] ..... H01R 33/72

[58] Field of Search ..... 339/192, 192 R, 192 RL, 339/192 T

[56] References Cited

UNITED STATES PATENTS

| | | | |
|---|---|---|---|
| 2,187,527 | 1/1940 | Wells | 339/192 R X |
| 2,648,827 | 8/1953 | Knollman | 339/256 |
| 2,760,173 | 8/1956 | Cunningham | 339/76 |
| 2,820,210 | 1/1958 | Petri | 339/192 R X |
| 3,341,805 | 9/1967 | De Vito | 339/111 |
| 3,404,368 | 10/1968 | Roberts et al. | 339/223 |
| 3,601,780 | 8/1971 | De Lyon | 339/192 RL |
| 3,850,496 | 11/1974 | Hague | 339/64 M |

*Primary Examiner*—Gerald A. Dost
*Attorney, Agent, or Firm*—Joseph E. Papin

[57] ABSTRACT

A terminal block assembly for an electrically energized device. The terminal block assembly has a housing, and a plurality of predeterminately spaced male terminals are mounted to the housing with spade portions extending from the housing. Means adapted for removable mounting with the male terminals has a casing containing a plurality of female terminals. The female terminals respectively include: a strip of electrical conductive material; opposite end portions on the strip respectively comprising a generally cylindric section and means for electrical connection with an electrical lead; and a bore in the cylindric section having a generally continuous circumferential portion for electrical contacting engagement with a respective one of the spade portions. A plurality of openings are predeterminately spaced in the casing for receiving the spade portions and include means engaged generally about the cylindrical sections of the female terminals for predeterminately positioning the bores thereof with respect to the openings. A plurality of means in said casing intersecting with the positioning means are provided for confining engagement with the other ends of the strips to generally prevent rotational displacement of the cylindric sections with respect to the openings. The spade portions are received in constant electrical contacting engagement across the circumferential portions irrespective of any diametral positions the spade portions extend through the openings into the bores when the removable mounting means is mounted with the male terminals.

A multiple connector assembly is also disclosed.

16 Claims, 10 Drawing Figures

TERMINAL BLOCK ASSEMBLY AND MULTIPLE CONNECTOR ASSEMBLY THEREFOR

FIELD OF THE INVENTION

This invention relates generally to electrical connectors of the quick connect and disconnect type and in particular to a terminal block assembly and a multiple connector assembly for an electrically energized device.

In the past, various types of terminal block assemblies have been utilized to effect quick connection and disconnection of a plurality of power or electrical leads to a plurality of terminals of an electrically energized device to effect its energization. These past terminal block assemblies included a housing having male terminals mounted therein for electrical connection with their electrically energized devices, and the male terminals protruded exteriorly of the housings for receiving in circuit relation a multiple connector assemble or female plug having compelmentary female terminals therein where are adpated for connection to a power source. In some of the past electrically energized devices, such as for instance sequence timers for dishwashers and clothes washers and dryers or the like, the housing for the past terminal block assemblies as separate from such device, and electrical leads connected with respective ones of the male terminals interiorly of the housing were led out therefrom for electrical connection with an associated electrically energized component of such past devices. In others of the past electrically energized devices, the housing for the terminal block assemblies thereof were integrally formed with such past devices, i.e., the housing of such past devices also served as the housing for the terminal block assembly to which was mounted the male terminals, as discussed above. For the most part, the multiple connector assembly of the past terminal block assemblies was mounted to the male terminals thereof only by the forces of an interference fit or frictional engagement between the respective ones of such male terminals and the complementary female terminals disposed in the female plug. One of the disadvantageous or undesirable features of the past terminal block assemblies and multiple connector assemblies therefor is believed to be that forces created by vibrations or the like encountered upon operation and/or handling of the past electrically energized devices caused the female terminals of the multiple connector assembly to become at least partially displaced and/or electrically disassociated from the male terminals of such past terminal block assemblies so as to interrupt or interfere with the energization of such devices.

Some of the past quick connect or disconnect female terminals utilized in the aforementioned past multiple connector assemblies were provided with a generally annular or cylindric section having a bore therethrough for receiving a male terminal, and the cylindric sections were split generally longitudinally or lengthwise of the bore thereof. In the aforementioned terminal block assemblies, when a male terminal having a flag or spade portion of a generally rectangular cross-section was inserted into electrical contacting engagement with the bore of such past female terminals so as to extend generally diametrally thereof, the aforementioned frictional or interference fit between a pair of opposite side edges of the spade portion and the bore could be effected to obtain the desired electrical contacting engagement therebetween. Of course, in order to effect the aforementioned interference fit for proper electrical contacting engagement, it was necessary to closely control the tolerances of the distance between the opposite side edges of the spade portion as well as the diametral tolerance of the cylindric section of the female terminal. However, one of the disadvantageous features of such past terminal block assemblies and multiple connector assemblies therefor is believed to be that the electrical contact between the sides of the male terminal spade portion and the bore of the female terminal cylindric section in the multiple connector assembly will not be constant if one of the sides is disposed over the longitudinal split in the cylindric section. Furthermore, in some of such past female terminals as employed in the past multiple connector assemblies, the split ends of the cylindric section of such past female terminals were disposed generally in abutting or end-to-end relation; however, one of the disadvantageous or undesirable features of such past terminal block assemblies and such past multiple connector assemblies employing this particular type of female terminal is believed to be that it was necessary to closely control the tolerances of the split bore thereof and a male terminal spade portion inserted generally diametrally into the bore in order to prevent displacement opening of the abutted split ends of the cylindric section. As previously mentioned, the spreading or opening of the abutted split ends is believed to have adversely affected the integrity of the electrical contacting engagement and frictional engagement of the male terminal spade portion if it was diametrally positioned in the bore of the cylindric section generally at the spread or opening between the abutted split ends thereof. In some of these past terminals, reinforcing bands or such similar means were provided about the cylindric sections to prevent the spread or opening of the abutted split ends thereof, but it is believed that the cost involved in this particular scheme resulted in disadvantages which might outweigh the end result thereof. In another of these past female terminals, the split ends of the cylindric section were supported generally against separation by a plurality of bands lanced from the cylindrical section generally opposite the split ends and depressed into the bores of the cylindric section so as to extend generally crosswise over the split ends. These bands were fused in place to the bore of the cylindric section. While these fused bands may have strengthened the cylindrical section to prevent opening of the split ends, it is believed that at least one of the disadvantageous features of this scheme was that it adversely affected the cost of making and was rather complicated for efficient manufacture.

SUMMARY OF THE INVENTION

Among the several objects of the present invention may be noted the provision of a terminal block assembly and a multiple connector assembly therefor which overcome the disadvantageous or undesirable features discussed hereinabove, as well as others, with respect to the prior art; the provision of such terminal block assembly and multiple connector assembly therefor wherein such multiple connector assembly has improved mounting characteristics and electrical contacting characteristics; the provision of such terminal block assembly and multiple connector assembly therefor in which such multiple connector assembly contains female terminals of strip electrical conductive material having a generally continuous circumferential portion of continuous electrical engagement with the spade portion of a male terminal irrespective of the diametral position thereof across the circumferential portion; and the provision of such terminal block assembly and multiple connector assembly therefor which are simplistic in design, economically manufactured and easily assembled. These as well as other objects and advantageous features of the present invention will be in part apparent and in part pointed out hereinafter.

In general, a terminal block assembly in one form of the invention for an electrically energized device is provided with a housing, and a plurality of predeterminately spaced male terminals are mounted to said housing including spade portions extending from said housing. Means adapted for removable mounting with the male terminals has a casing containing a plurality of female terminals. The female terminals respectively include: a strip electrical conductive material having opposite end portions respectively comprising a generally cylindric section and means for electrical connection with an electrical lead; and a bore in the cylindric section having a generally continuous circumferential portion for electrical contacting engagement with a respective one of the spade portions. A plurality of openings are predeterminately spaced in said casing for receiving the spade portions and include means engaged generally about the cylindrical sections of the female terminals for predeterminately positioning the bores thereof with respect to the openings. A plurality of means are provided in the casing intersecting with the positioning means for confining engagement with the other ends of the strips to generally prevent rotational displacement of the cylindric sections with respect to the openings. The spade portions are received in constant electrical contacting engagement across the circumferential portions irrespective of any diametral positions the spade portions may extend through the openings into the bores when the removable mounting means is mounted with the male terminals.

In general, a multiple connector assembly in one form of the invention is adapted to be removably mounted to a plurality of male terminal spade portions. The multiple connector assembly has a casing with at least one face. A plurality of female terminals are provided in the casing, and they respectively include: a strip of electrical conductive material having a generally cylindric section adjacent one end thereof; a bore in the cylindric section having a generally continuous circumferential portion for electrical contacting engagement with the male terminal spade portion; and means adjacent the other end of the strip for electrical connection with an electrical lead. A plurality of predeterminately spaced openings are provided in the casing intersecting with the at least one face thereof and include means engaged with the cylindric sections for aligning the bores with the openings and generally preventing lateral displacement movement of the cylindric sections with respect to the openings. A plurality of means communicating with the openings for receiving the strips include means for confining engagement with the other ends of the strips so as to generally maintain the cylindric sections thereof against rotational displacement with respect to the openings. Means is provided in the casing for passing thereinto electrical leads to connect with electrical connection means of the female terminals. The male terminal spade portions are received in constant electrical contacting engagement across the continuous circumferential portions irrespective of any diametral position the male terminal spade portions may be inserted through the openings into the bores when the multiple connector assembly is removably mounted to the male terminal spade portions.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting the scope of the invention in any manner.

DETAILED DESCRIPTION OF THE PREFERRED EMBODIMENTS

Figure 1:
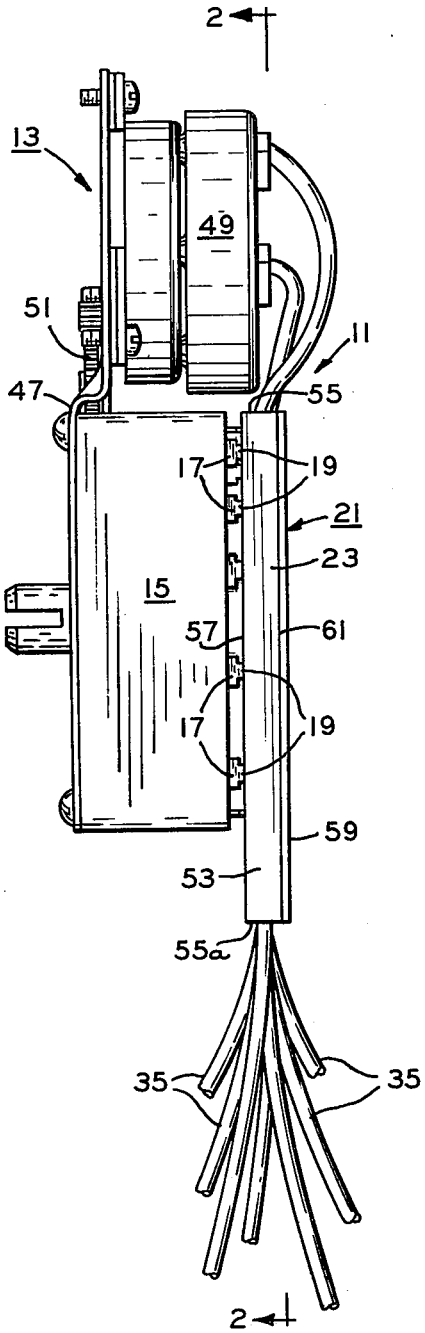
FIG. 1 is a side elevational view of the electrically energized component mounted to a support on a device in which it functions and illustrating a terminal block in one form of the present invention which includes a multiple connector assembly also in one form of the invention.
Figure 2:
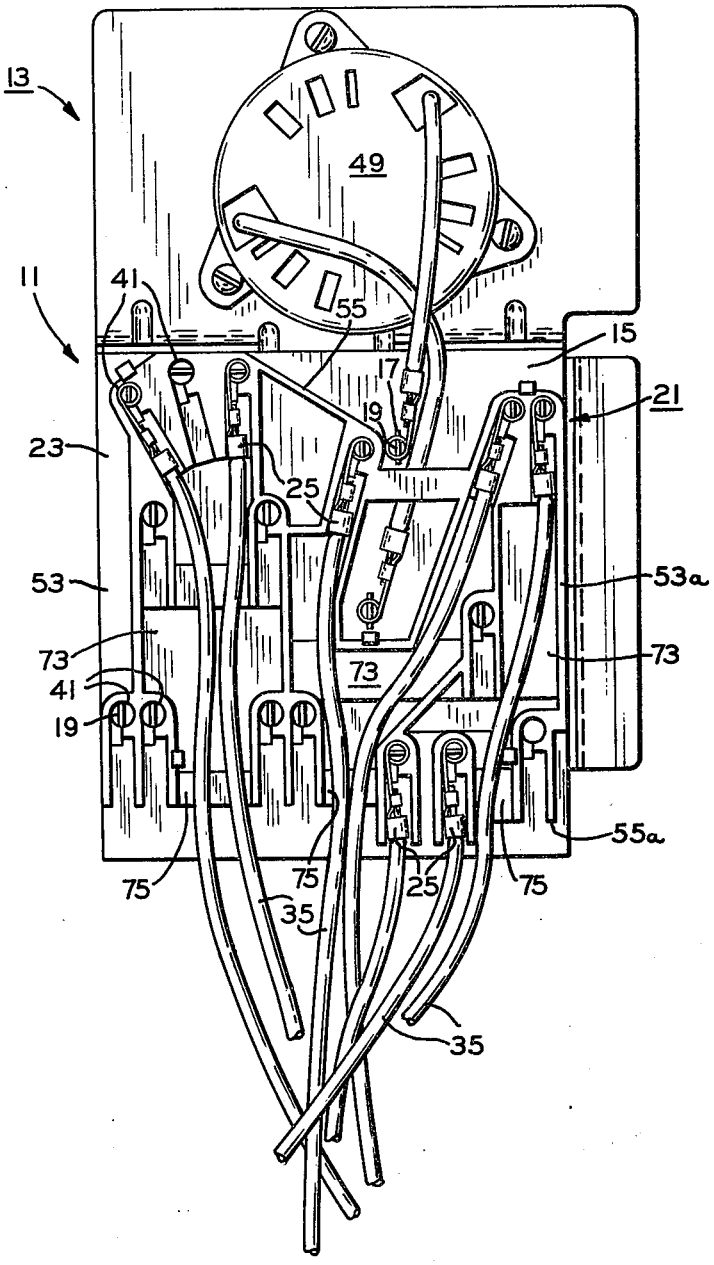
FIG. 2 is a sectional view taken along line 2—2 of Fig. 1 and showing the interior of the multiple connector assembly.
Figure 3:
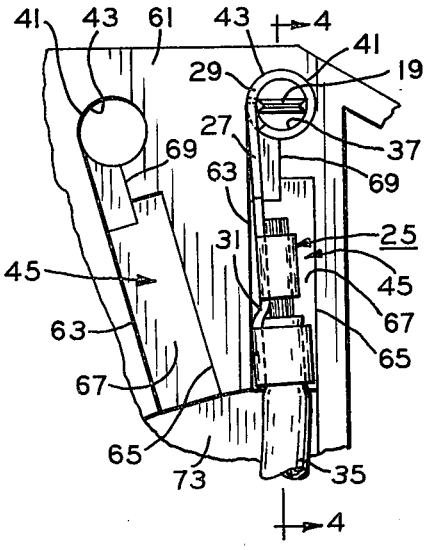
FIG. 3 is an enlarged partial plan view of the interior of the multiple connector assembly taken from FIG. 2.
Figure 4:
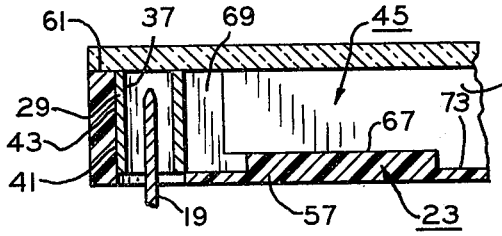
FIG. 4 is a sectional view taken along 4—4 of FIG. 3.
Figure 5:
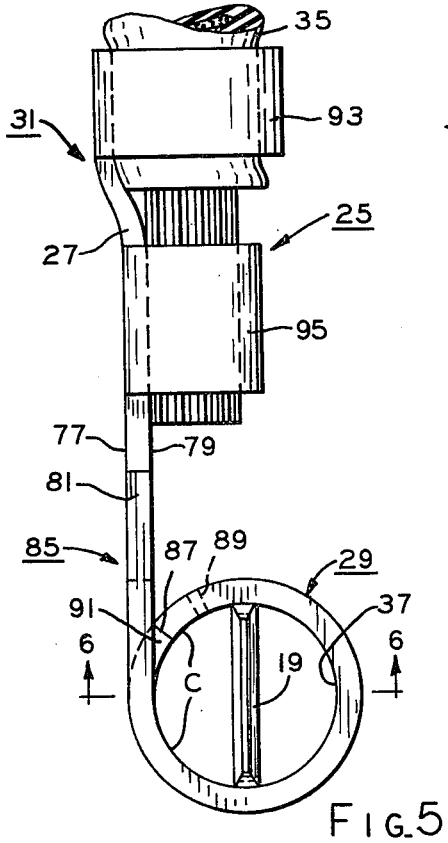
FIG. 5 is an enlarged side elevational view of a female terminal utilized in the multiple connector assembly as shown in FIGS. 2 and 3.
Figure 6:
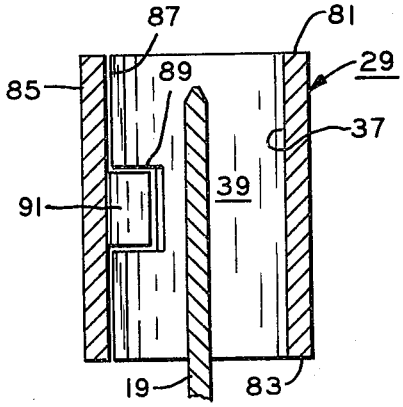
FIG. 6 is a sectional view taken along line 6—6 of FIG. 5.

Referring to the drawings in general, there is shown in one form of the invention a terminal block assembly 11 for an electrically energized device, such as a sequence timer indicated generally at 13 for instance, which is provided with a housing 15, and a plurality of predeterminately spaced male terminals 17 are mounted to the housing with spade or flag portions 19 thereof extending from the housing (FIG. 1). Means, such as a multiple connector assembly or female plug 21, is adapted for removable mounting with male terminals 17 and has a casing 23 containing a plurality of female terminals 25 (FIGS. 1 and 2). Female terminals 25 respectively include: a strip or body 27 of an electrical conductive material having opposite end portions 29, 31 respectively comprising a generally cylindric section and means for electrical connection with an electrical lead 35; and a bore 37 is provided in the cylindric section having a generally continuous circumferential portion 39 for electrical contacting engagement with a respective one of spade portions 19 (FIGS. 5 and 6). A plurality of openings 41 are predeterminately spaced in casing 23 for receiving spade portions 19 and include means, such as generally cylindric sidewalls 43, engaged generally about cylindric sections 29 of female terminals 25 for predeterminately positioning bores 37 thereof with respect to the openings (FIGS. 2–4). A plurality of means, such as channels or slots 45, are provided in casing 23 intersecting with the positioning means or cylindric sidewalls 43 for confining engagement with the other end portions 31 of strips 27 to generally prevent rotational movement of cylindric sections 29 with respect to openings 41 (FIGS. 2–5). Spade portions 19 are received in constant electrical contacting engagement across circumferential portions 39 of bores 37 in female terminals 25 irrespective of any diametral positions the spade portions extend through casing openings 41 into the bores when the removable mounting means or multiple connector assembly 21 is mounted with male terminals 17 (FIGS. 1–6).

More particularly and with specific reference to FIGS. 1 and 2, sequence timer 13 is mounted by suitable means to a support or plate 47 which, in turn, may be disposed in a unit, such as an electric range, dishwashers, clothes washers and dryers or the like, having components adapted to be controlled or regulated by such sequence timer. Sequence timer 13 includes a timing motor 49 which is drivingly connected by suitable gearing 51 to other components thereof (not shown) within housing 15 which may be formed of any suitable dielectric material. Although housing 15 is illustrated for purposes of disclosure as being an integral part of sequence timer 13, it is contemplated that such housing may be a separate entity within the scope of the invention and still meet the objects and advantageous features thereof.

In order to insure proper mounting of multiple connector assembly 21 in correct circuit relation with the various male terminals 17 disposed in housing 15 of terminal block assembly 11, the male terminals are predeterminately spaced with respect to each other, and spade portions 19 of the male terminals extend from the housing exteriorly thereof in different angular relationships with respect to each other. In this manner, multiple connector assembly 21 may be removably mounted only in one position to spade portions 19 of male terminals 17 thereby to insure the establishment of the proper circuit relations in terminal block assembly 11.

Casing 23 of multiple connector assembly 21 may be formed of any suitable dielectric material and is provided with integral pairs of opposite sides 53, **53*a* and 55, 55*a* with a face or base wall 57 integrally disposed therebetween. A closure member or cover 59 extends across an open or terminal receiving face 61 of casing 23 opposite face 57 thereof engaging with at least casing sides 53, 53*a* and 55, 55*a*, and the cover may be releasably secured in any suitable manner (not shown) to the casing so as to comprise a closed wall or face thereof. If desired, cover 59 may be transparent so that the various electrical connections within casing 23** may be visually and quickly checked.

Referring now to FIGS. 2–4, openings 41 are provided through casing 23 intersecting with opposite faces 59, 61 thereof, and the openings are predeterminately grouped or spaced corresponding with the predetermined spacing of male terminals 17 in housing 15 thereby to insure proper mounting or assembly of multiple connector assembly 21, as previously discussed. Cylindric sidewalls 43 of openings 41 within casing 23 are intersected by pairs of opposed spaced apart wall means 63, 65, and base or connecting walls 67, which also intersect the cylindric sidewalls, are connected between the wall means. Wall means 63, 65 and connecting walls 67 generally comprise channels 45, and the wall means extend generally perpendicularly with respect to casing faces 57, 61 while the connecting walls are generally parallel thereto. It may be noted that wall means 63 intersect generally tagentially with cylindric sidewalls 43 of openings 41, and wall means 65 have stepped parts or portions 69 intersecting with the cylindric sidewalls and spaced from sidewalls 63 a distance less than the diameter of the cylindric sidewalls. Connecting wall 67 may be stepped at 71 to provide a locking or seating engagement with female terminals 25. The ends of channels 45 generally opposite their intersections with cylindric sidewalls 43 of openings 41 communicate or open into respective ones of a plurality of partitioned chambers 73 within casing 23, as best seen in FIG. 2, and such partitioning of the casing is effected to prevent arcing or flash over between the various circuits of multiple connector assembly 21. It may also be noted that channels 45 in any of partitioned chambers 73 are also isolated from each other to prevent arcing of flash over between female terminals 25 housed in such channels. Means, such as passages or openings 75, are provided in side **55*a* of casing 23 for the passage thereinto of electrical leads 35 to connect with female terminals 25**.

Female terminal 25, as shown in FIGS. 5 and 6, is formed from strip 27 of electrical conductive material having opposite faces 77, 79 interconnected generally crosswise of the strip between opposite sides 81, 83 thereof, and a generally planar or intermediate portion 85 of the strip is integrally interposed between opposite or distal end portions 29, 31 which, as previously mentioned, respectively comprise the cylindric section of the strip and the electrical connection means thereof. Cylindric section 29 is provided with a predetermined or preselected curvature C, and a free end 87 of strip 27 terminating the cylindric section has a slot, groove or other opening 89 therein through opposite faces 77, 79 so as to intersect with bore 37 extends within the cylindric section crosswise of the strip between sides 81, 83 thereof. A tab or extension 91 is lanced from intermediate portion 85 of strip 27, and the tab is bent or otherwise displaced from the plane of the strip through opposite face 79 thereof into slot 89 in cylindric section 29. It may be noted that tab 91 is deformed so as to have generally the same curvature C as cylindric section 29; therefore, with the tab disposed in slot 89 and having the same curvature C as the cylindric section, the generally continuous circumferential portion 39 is established about bore 37 which affords constant electrical contacting engagement with a respective one of spade portions 19 irrespective of the diametral position in which such spade portion may extend into the bore across the continuous circumferential portion thereof, as discussed hereinafter. Electrical connection means of opposite end portion 31 of strip 27 has oppositely extending, spaced apart pairs of arms 93, 95 integral with the strip, and such arms may be folded, bent or otherwise deformed into clamping and electrical contacting engagement with electrical lead 35. While this particular type of electrical connection means 31 has been illustrated for purposes of disclosure, it is contemplated that other electrical connection means may be formed on or associated with strip 27 within the scope of the invention so as to meet the objects and advantageous features thereof. If further discussion of the formation and/or construction of female terminal 25 is desired, reference may be had to the copending application of Richard A. Wandler, Ser.

No. 645,044 filed Dec. 29, 1975 which is specifically incorporated by reference into this application.

In the assembly of multiple connector assembly 21, female terminals 25 may, of course, be electrically connected with various selected ones of leads 35, as previously discussed, and the female terminals are then inserted or placed in selected ones of openings 41 and channels 45 provided in casing 23. Cylindric sections 29 of female terminals 25 are inserted into openings 41 with intermediate portion 85 and opposite end portion 31 extending generally along wall means 63 of channels 45. In this manner, it may be noted that the engagement of cylindric sidewalls 42 in openings 41 generally about cylindric sections 29 of female terminals 25 not only serves to align bores 37 thereof with the openings but also prevents displacement movement of the female terminals generally laterally of the openings. Further, it may also be noted that opposite end portions 31 of strips 27 are confined between wall means 63, 65 of channels 45 so as to generally prevent rotational displacement movement of cylindric sections 29 of the strips within openings 41. In other words, generally opposed portions of wall means 63, 65 comprises means for abutting engagement with the electrical connection means of the strip included in opposite end portion 31 thereof. Of course, sides 81 of strips 27 rest on or are engaged with base walls 67 of channels 45 when female terminals 25 are placed therein. With female terminals 25 so positioned in openings 41 and channels 45, respective leads 35 connected with such female terminals may be run through proper partitioned chambers 73 in casing 23 and passed through lead out passages 75 associated with the partitioned chambers. Cover 59 may be secured by suitable means (not shown) onto casing face 61, and it may be noted that the cover extends over openings 41 and channels 45 for displacement preventing engagement with at least a part of sides 83 on strips 27 of female terminals 25. When casing 23 and cover 59 are so assembled together with female terminals 25 and leads 35 positively positioned therein against displacement movement, as described above, multiple connector assembly 21 may be removably mounted in circuit relation to male terminals 17 of housing 15.

As multiple connector assembly 21 is mounted to male terminals 17, openings 41 in face 57 of casing 73 are passed over respective ones of male terminal spade portions 19 which are inserted into bores 37 of female terminals 25 contained in the casing, and it may be noted that irrespective of the particular angular or diametral position in which the spade portions enter the bores, the spade portions are received in constant electrical contacting engagement across continuous circumferential portions 39 of the bores.

Figure 7:
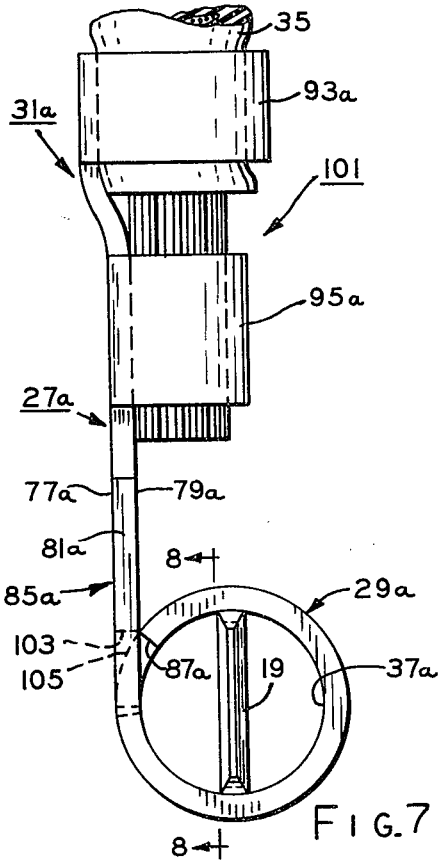
FIGS. 7 and 9 are side elevational views of alternative female terminals which may be utilized in the multiple connector assembly.
Figure 8:
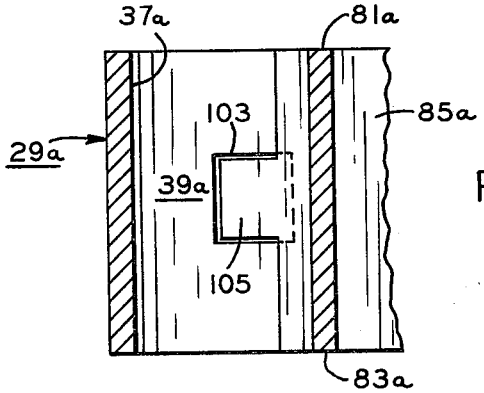
FIGS. 8 and 10 are sectional views taken along line 8—8 and line 10—10 of FIGS. 7 and 9, respectively.

Referring now to FIGS. 7 and 8, an alternative female terminal 101 for utilization multiple connector assembly 21 is shown having generally the same component parts which function generally in the same manner as those of the above-discussed female terminal 25 with the exceptions set out hereinafter. The parts of female terminal 101 which correspond with those of female terminal 25 are designated by the letter *a*.

Female terminal 101 is provided with an opening or aperture, such as a slot 103 or the like in intermediate portion **85*a* of strip 27*a* through opposite faces 77*a*, 79*a* thereof generally adjacent cylindric section 29*a*. A tab or extension 105 is integrally provided on end 87*a* of cylindric section 29*a*, and the tab has generally the same curvature C as the cylindric section. Tab 105 is bent or otherwise deformed into dovetailing relation with slot 103 in intermediate portion 85*a* of strip 27*a* so as to provide continuous circumferential portion 38*a* within bore 37*a* of cylindric section 29*a*. It may be noted that continuous circumferential portion 39*a* of bore 37*a* is operable to provide continuous electrical contacting engagement with a respective one of spade portions 19 on male terminals 17 irrespective of the diametral position the spade portion is received in the bore across the continuous circumferential portion thereof. Female terminal 101 may be assembled within casing 23 of multiple connector assembly 21 in the same manner as discussed hereinabove with respect to female terminal 25, and it is believed that the multiple connector assembly utilizing female terminals 101 will meet the objects and advantageous features of the invention set out hereinbefore. If a more detailed discussion of the formation and/or construction of female terminal 101** is desired, reference may be had to the copending application of Richard A. Wandler, Ser. No. 645,044 filed Dec. 29, 1975 which is incorporated herein by reference, as previously mentioned.

Figure 9:
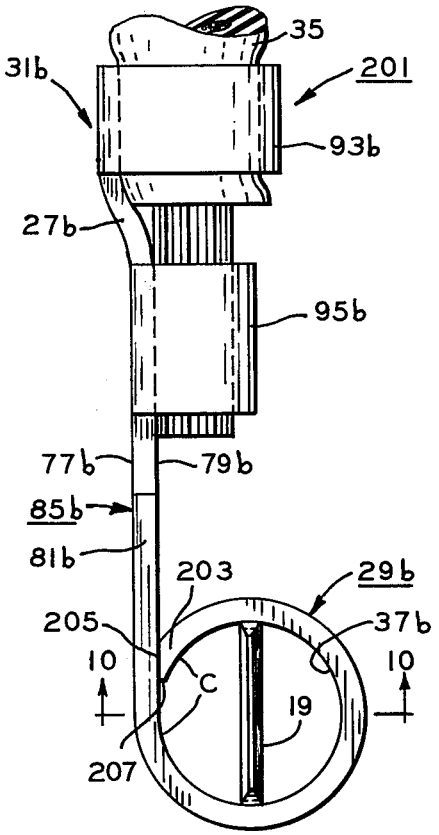
Figure 10:
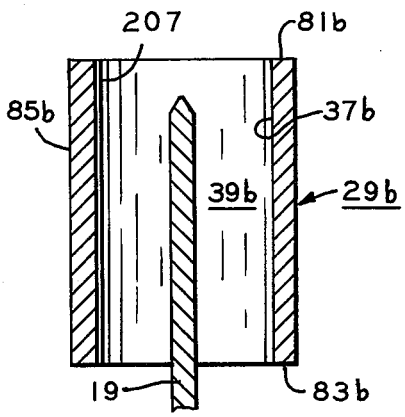

Another alternative female terminal 201, FIGS. 9 and 10, for utilization in multiple connector assembly 21 is shown having generally the same component parts which function generally in the same manner as those of the above-discussed female terminal 25 with the exceptions set out hereinafter. The parts of female terminal 201 which correspond with those of female terminal 25 are designated by the letter *b*.

Female terminal 201 is provided with a beveled end 203 on strip **27*b* terminating cylindric section 29*b* thereof, and the beveled end has a beveled surface 205 intersecting with opposite faces 77*b*, 70*b* of the strip between sides 81*b*, 83*b* thereof so as to define an end edge 207. Beveled surface 205 is generally abutted with opposite face 79*b* on intermediate portion 85*b* of strip 27*b*, and end edge 207 is disposed in a position with respect to the opposite face defining bore 37*b* within cylindric section 29*b* so that curvature C of the bore on opposite sides of the end edge is generally blended together so as to provide a generally continuous or uninterrupted circumferential portion 39*a* of the bore between opposite sides 81*b*, 83*b* of the strip. In other words, beveled surface 205 abuts intermediate portion 85*b* in such a manner that curvature C of bore 37*b* across or on opposite sides of end edge 207 is generally constant and the bore is generally continuous. It may be noted that continuous circumferential portion 39*b* or bore 37*b* is operable to effect continuous electrical contacting engagement with a respective one of male terminal spade portions 17 irrespective of the diametral position the spade portion is received in the bore across the continuous circumferential portion thereof. Female terminal 201 may be assembled within casing 23 of multiple connector assembly 21 in the same manner as previously discussed hereinabove with respect to female terminal 25, and it is believed that the multiple connector assembly utilizing female terminal 201 will meet the objects and features of the invention set out hereinbefore as well as others. If a more detailed discussion of the formation and/or construction of female terminal 201** is desired, reference may be had to the copending application of David C. Lennon, Ser. No. 645,043 filed Dec. 29, 1975 which is incorporated herein by reference, as previously mentioned.

From the foregoing, it is now apparent that a novel terminal block assembly 11 and a novel multiple connector assembly 21 therefor are provided meeting the objects and advantageous features set out herein as well as other, and it is contemplated that changes as to the precise configurations, shapes, details and connections of the constructions presented herein merely to illustrate the invention may be made by those having ordinary skill in the art without departing from the spirit of the invention or the scope thereof as set out by the claims which follow.

What we claim as new and desire to secure as Letters Patent of the United States is:

1. A multiple connector assembly adapted to be removably mounted to a plurality of male terminal spade portions comprising a casing having at least one face; a plurality of female terminals in said casing and respectively including an integral strip of electrical conductive material having a generally cylindric section at one end thereof, a bore within said cylindric section having a generally continuous circumferential portion crosswise of said strip for electrical contacting engagement with the male terminal spade portion, and means adjacent the other end of the strip for electrical connection with an electrical lead; means within said casing for locating said female terminals therein including a plurality of predeterminately spaced openings with said at least one face for receiving the male terminal spade portions and having generally cylindric sidewalls engaged about said cylindric sections to align said bores with said openings, and a plurality of pairs of opposed wall means intersecting with said cylindric sidewalls, said electrical connection means being disposed between said wall means pairs for abutting engagement therewith to predeterminately limit rotational movement of said cylindric sections in said openings; and means in said casing for passing thereinto electrical leads to connect with said electrical connection means, the male terminal spade portions being received in constant electrical contacting engagement across said continuous circumferential portions of said bores irrespective of any diametral positions the male terminal spade portions may be inserted through said openings into said bores when the multiple connector assembly is removably mounted to the male terminal spade portions.

2. A multiple connector assembly as set forth in claim 1 further comprising a cover releasably secured to said casing and extending over said openings and said wall means pairs, said cover comprising another face of said casing generally opposite said at least one face thereof.

3. A multiple connector assembly as set forth in claim 1 wherein one of said wall means of said wall means pairs intersects generally tangentially with said cylindric sidewalls, respectively.

4. A multiple connector assembly as set forth in claim 1 wherein at least a part of one of the wall means of said wall means pairs is laterally spaced from the other of the wall means of said wall means pairs a distance less than the diameter of the cylindric sidewalls of said openings, respectively.

5. A multiple connector assembly as set forth in claim 1 wherein said locating means further includes a plurality of base walls disposed between said wall means pairs and intersecting with said cylindric sidewalls for engagement with a side edge of said strips, respectively.

6. A multiple connector assembly as set forth in claim 1 wherein said wall means pairs are disposed in planes extending generally parallel with the axes of said cylindric sidewalls of said openings, respectively.

7. A multiple connector assembly adapted to be removably mounted to a plurality of male terminal spade portions, said assembly comprising a casing having at least one face; a plurality of female terminals in said casing and respectively including an integral strip of electrical conductive material having a generally cylindric section adjacent one end thereof, an outer peripheral portion on said cylindric section, a bore in said cylindric section having a generally continuous circumferential portion for electrical contacting engagement with the male terminal spade portion, and means adjacent the other end of said strip for electrical connection with an electrical lead; a plurality of predeterminately spaced openings in said casing intersecting with said at least one face thereof and including means engaged with and extending about said outer peripheral portion of said cylindric sections for aligning said bores with said openings and generally preventing lateral displacement movement of said cylindric sections with respect to said openings; a plurality of means communicating with said openings for receiving said strips including means for confining engagement with said other ends of said strips so as to generally maintain said cylindric sections thereof against rotational displacement movement with respect to said openings within said aligning and preventing means thereof; and means in said casing for passing thereinto electrical leads to connect with said electrical connection means of said female terminals, the male terminal spade portions being received in constant electrical contacting engagement across said continuous circumferential portions irrespective of any diametral position the male terminal spade portions may be inserted through said openings into said bores when the multiple connector assembly is removably mounted to the male terminal spade portions.

8. A multiple connector assembly as set forth in claim 7 wherein said aligning and preventing means respectively comprise generally annular wall means in said casing.

9. A multiple connector assembly as set forth in claim 7 wherein said receiving means respectively comprise a pair of spaced apart wall means in said casing.

10. A multiple connector assembly as set forth in claim 7 wherein said aligning and preventing means comprise a generally cylindric sidewall on said casing about said openings.

11. A multiple connector assembly as set forth in claim 10 wherein said receiving means comprise pair of opposed wall means on said casing intersecting with said cylindric sidewall, and a pair of opposed abutment portions on said wall means for engagement with said electrical connection means, respectively.

12. A terminal block assembly for an electrically energized device comprising a housing; a plurality of predeterminately spaced male terminals mounted in said housing and having spade portions extending from said housing, at least some of said spade portions being disposed at different angles with respect to at least some of the others of said spade portions; a multiple connector assembly adapted to be removably mounted to said spade portions in electrical circuit relation with said male terminals and including a casing having a plurality of female terminals therein, said female terminals respectively including a strip of electrical conductive material having generally opposite end portions, one of said opposite end portions comprising a generally cylindric section, a bore within said cylindric section having a generally continuous circumferential portion for electrical contacting engagement with a respective one of said spade portions, and the other of said opposite end portions of said strip including means for electrical connection with an electrical lead; a plurality of openings predeterminately spaced in said casing fo receiving said spade portions and having generally cylindric sidewalls engaged about said cylindric sections of said female terminals to align said bores thereof with said openings; a plurality of pairs of opposed wall means in said casing respectively intersecting with said cylindric sidewalls, said other opposite end portions of said strips being disposed between said wall means pair for abutting engagement therewith to predeterminately limit rotational movement of said cylindric sections in said openings; and said spade portions extending through said openings into said bores and generally diametrally across said continuous circumferential portions in constant electrical contacting engagement therewith irrespective of the angular dispositions of said spade portions with respect to each other when said multiple connector assembly is removably mounted to said spade portions in the electrical circuit relation with said male terminals.

13. A terminal block assembly as set forth in claim 12 wherein one of said wall means of said pairs thereof intersects generally tangentially with said cylindric sidewalls of said openings, respectively.

14. A terminal block assembly as set forth in claim 12 wherein at least a part of one of said wall means of said pairs thereof is spaced from the other of said wall means of said pairs thereof a distance less than the diameter of said cylindric sidewalls of said openings, respectively.

15. A terminal block assembly as set forth in claim 12 further comprising means in said casing for the passage thereinto of a plurality of electrical leads to connect with said electrical connection means of said female terminals.

16. A terminal block assembly for an electrically energized device comprising a housing; a plurality of predeterminately spaced male terminals mounted to said housing including spade portions extending from said housing; means adapted for removable mounting with said male terminals including a casing containing a plurality of female terminals; said female terminals respectively including an integral strip of electrical conductive material, a pair of opposite end portions on said strip respectively comprising a generally cylindric section and means for electrical connection with an electrical lead, and a bore in said cylindric section having a generally continuous circumferential portion for electrical contacting engagement with a respective one of said spade portions; a plurality of openings predeterminately spaced in said casing for receiving said spade portions and including means engaged with and extending generally about said cylindric sections of said female terminals for predeterminately positioning said bores thereof with respect to said openings; a plurality of means in said casing intersecting with said positioning means for confining engagement with said electrical connection means to generally prevent rotational displacement of said cylindric sections with respect to said positioning means; and said spade portions being received in constant electrical contacting engagement across said continuous circumferential portion irrespective of any diametral positions said spade portions extend through said openings into said bores when said removable mounting means is mounted with said male terminals.

* * * * *

UNITED STATES PATENT AND TRADEMARK OFFICE

CERTIFICATE OF CORRECTION

PATENT NO. : 4,030,802

DATED : June 21, 1977

INVENTOR(S) : David C. Lennon & Richard A. Wandler

It is certified that error appears in the above-identified patent and that said Letters Patent are hereby corrected as shown below:

Col. 1, line 22, delete "where" and insert --which--;
line 22, delete "adpated" and insert --adapted--;
line 33, delete "were" and insert --was--.
Col. 3, line 2, delete "of" and insert --for--;
line 19, after "strip" insert --of--;
line 61, delete "include" and insert --includes--;
line 64, after "placement" insert --movement--.
Col. 4, line 20, after "along" insert --line--.
Col. 6, line 4, delete "tagentially" and insert --tangentially--
Col. 7, line 62, delete "a" and insert --"a"--.
Col. 8, line 4, delete "38a" and insert --39a--;
line 31, delete "b" and insert --"b"--;
line 35, delete "70b" and insert --79b--.
Col. 9, line 27, after "openings" insert --intersecting--.
Col. 11, line 8, delete "fo" and insert --for--.

Signed and Sealed this

Thirtieth Day of May 1978

[SEAL]

Attest:

RUTH C. MASON
Attesting Officer

LUTRELLE F. PARKER
Acting Commissioner of Patents and Trademarks